US005550572A

United States Patent [19]

Chang et al.

[11] Patent Number: 5,550,572

[45] Date of Patent: Aug. 27, 1996

[54] COLOR VIDEO PRINTER FOR DOUBLE SIDE PRINTING

[75] Inventors: Ki-Son Chang; Moon-Bae Park; Dong-Hwan Kang, all of Suwon, Rep. of Korea

[73] Assignee: Samsung Electronics Co., Ltd., Kyungki-Do, Rep. of Korea

[21] Appl. No.: 93,713

[22] Filed: Jul. 20, 1993

[30] Foreign Application Priority Data

Jul. 20, 1992 [KR] Rep. of Korea ..... 12897/1992

[51] Int. Cl.[6] ..... B41J 2/325; B41J 11/00

[52] U.S. Cl. ..... 347/171; 347/197; 347/218

[58] Field of Search ..... 347/140, 197, 347/198, 140, 171, 218; 400/120.16, 120.17, 120 HE, 120.96

[56] References Cited

U.S. PATENT DOCUMENTS 5,001,498 3/1991 Shimizu et al. ..... 347/219

5,317,373 5/1994 Bares ..... 347/140

*Primary Examiner*—Benjamin R. Fuller

*Assistant Examiner*—L. Anderson

*Attorney, Agent, or Firm*—Sughrue, Mion, Zinn, Macpeak & Seas

[57] ABSTRACT

A color video printer for printing onto both sides of a printing paper includes several guide rollers positioned on the circumference of a platen roller and an ink ribbon supplying unit. A thermal recording head is selectively contacted with or separated from the platen roller by the operation of a cam, and a slider is operated by the cam. In the slider, cam grooves are formed so as to operate a paper ejecting guide and a re-feed paper roller by its reciprocating motion.

5 Claims, 7 Drawing Sheets

COLOR VIDEO PRINTER FOR DOUBLE SIDE PRINTING

FIELD OF THE INVENTION

The present invention relates to color video printers, and more particularly to a color video printer for printing onto both sides of printing paper.

BACKGROUND OF THE INVENTION

A color videoprinter has been proposed according to the necessity for printing the record of a video signal by instantaneous capture of an object, or an image to be reproduced on a monitor through a recording apparatus such as a still camera. Moreover, a sublimate heat conduction system for sequentially sublimating three primary colors (3-color) of yellow (Y), magenta (M) and cyan (C) capable of expressing various tones and recording full colors has been used.

Referring to FIG. 1, there is shown this type color video printer. A thermal paper 5 is fed by the transferring force generated by the rotation of a feed paper roller 11, and then, positioned on the circumference of a drum 4 located below an ink ribbon 6 where the sublimate dyestuffs of the 3-colors of yellow (Y), magenta (M) and cyan (C) are sequentially formed. Thereafter, the thermal paper 5 moves close to the drum 4, together with the ink ribbon 6 by the pressure of a thermal recording head 3 located above the ink ribbon 6.

At this time, if the drum 4 rotates, the thermal paper 5 and the ink ribbon 6 come into contact with one another by the frictional force of the drum 4 and the thermal paper 5 proceeds with the same speed as the drum 4. When the drum 4 revolves, if the thermal recording head 3 emits heat, the dyestuffs of the ink ribbon 6 are sublimated according to the heating value of the thermal recording head 3 and adhered to the thermal paper 5. Thus, mixed colors become different by the amount of ink of the 3-color of sequentially adhered yellow (Y), magenta (M) and cyan (C), and as a result, the printing for all the colors is ended.

If the printing is finished, the thermal paper 5 is separated from the drum 4 and comes out of a printing machine by the turning force of a paper ejecting roller 12. In this case, the thermal paper 5 used for printing purposes contains, as shown in FIG. 2, a pulp layer 74, a polyethylene layer 76 and a dyestuffs absorptive layer 78 and only one side is printed.

However, in such a conventional color video printer, since only one side of the printing paper is printed and the platen drum further revolves by one rotation in order to eject the printing paper after printing the 3-colors of yellow (Y), magenta (M) and cyan (C), the printing speed is slow.

SUMMARY OF THE INVENTION

It is accordingly an object of the present invention to provide a color video printer capable of improving printing speed by ejecting printing paper while completing the printing of cyan (C) color.

It is another object of the present invention to provide a color video printer capable of printing on both sides of printing paper by re-feeding the paper after one side of the paper is printed.

In accordance with one aspect of the present invention, a thermal recording head and a slider are operated by a cam, and a paper ejecting guide and re-feed paper roller are operated by the slider. A printing paper contains a polyethylene layer and a dyestuffs absorptive layer which are symmetrically formed relative to a pulp layer.

BRIEF DESCRIPTION OF THE DRAWINGS

The above and other objects, advantages and features of the present invention will become apparent from the following detailed description taken with the attached drawings, in which.

DETAILED DESCRIPTION OF THE PREFERRED EMBODIMENT

Figure 3:
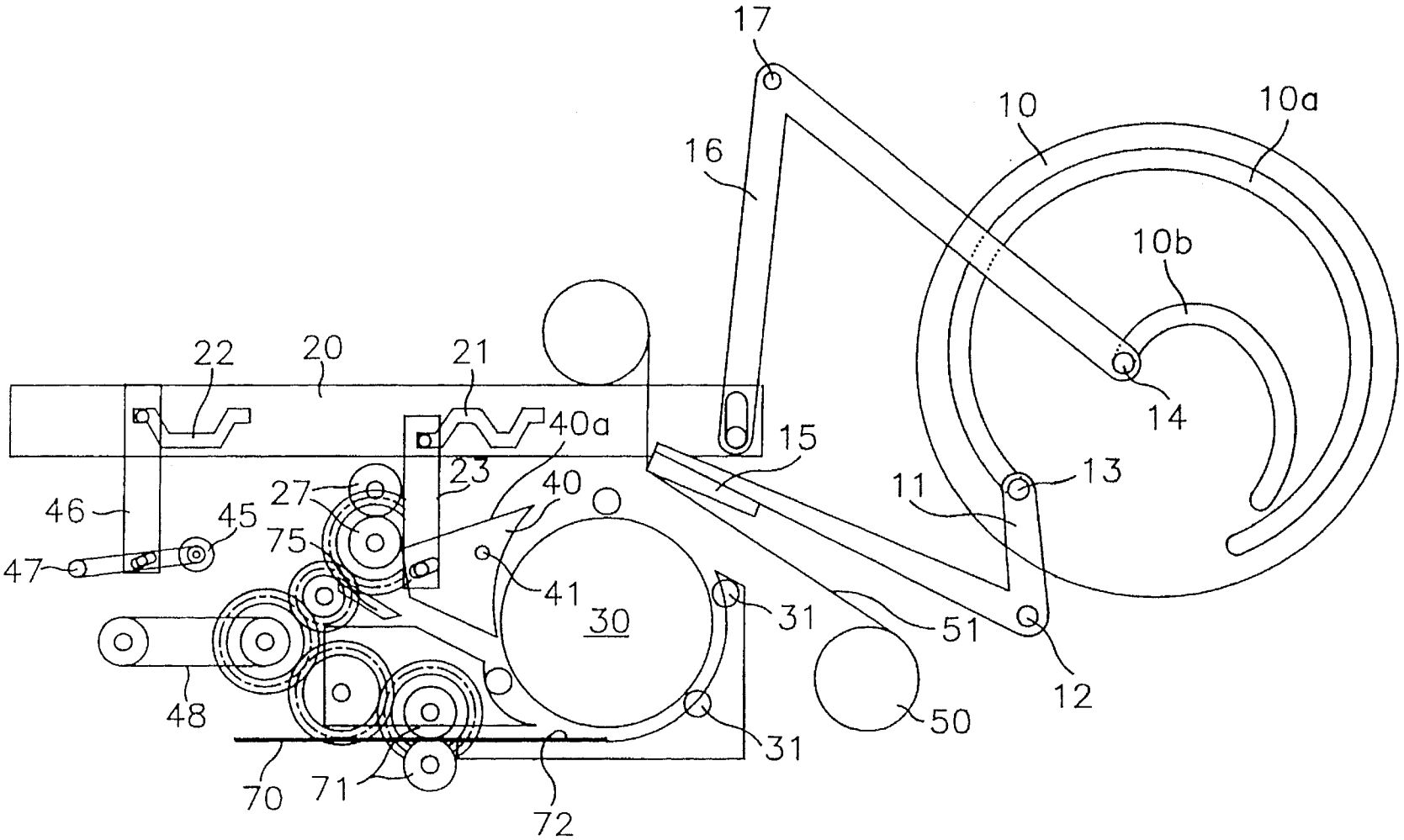
FIG. 3 is a schematic block diagram of a color video printer according to the present invention.

Referring to FIG. 3, there are provided a plurality of guide rollers 31 positioned on the circumference of a platen roller 30. There is also provided an ink ribbon supplying unit 50. A thermal recording head 15 is selectively contacted with or separated from the platen roller 30 by the operation of a cam 10, and a slider 20 is operated by the cam 10. In the slider 20, cam grooves 21 and 22 are formed so as to operate a paper ejecting guide 40 and a re-feed paper roller 45 by its reciprocating motion.

A printing paper 70 supplied from a feed paper unit is guided to a feed paper guide 72 by a feed paper roller 71 and arrives at the platen roller 30. Then the printing paper 70 moves close to the platen roller 30 by a holder (not shown) and is shifted with the same speed as the platen roller 30 to an initial position to be printed.

Figure 4A:
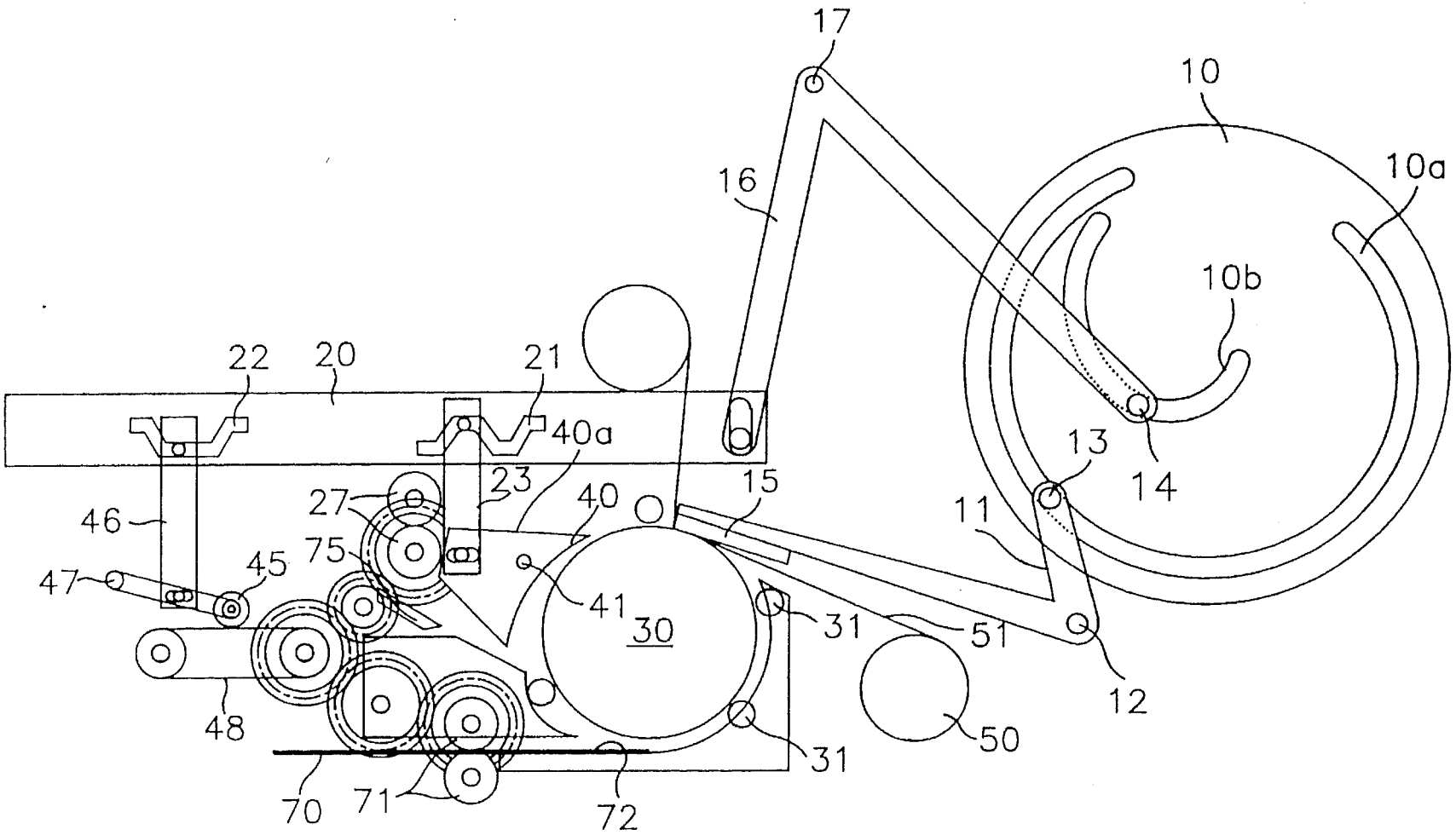
FIGS. 4A to 4E are schematic block diagrams showing printing processes according to the present invention.

Thereafter, if the cam 10 rotates, a thermal recording head driving lever 11 operated by a cam groove 10*a* rotates about a hinge axis 12. Then the thermal recording head 15 moves close to the platen roller 30 together with a ribbon 51 and simultaneously a slider driving lever 16 revolves about a hinge axis 17 by a cam groove 10*b*. Hence, the slider 20 is shifted to the left side. At this time, the paper ejecting guide 40 revolves clockwise round an axis 41 because a bracket 23 hanging on the cam groove 21 moves up. Moreover, the re-feed paper roller 45 does not operate because the one end of a bracket 46 hanging on the cam groove 22 is located on the flat bottom of the cam groove 22 (FIG. 4A).

Figure 4B:
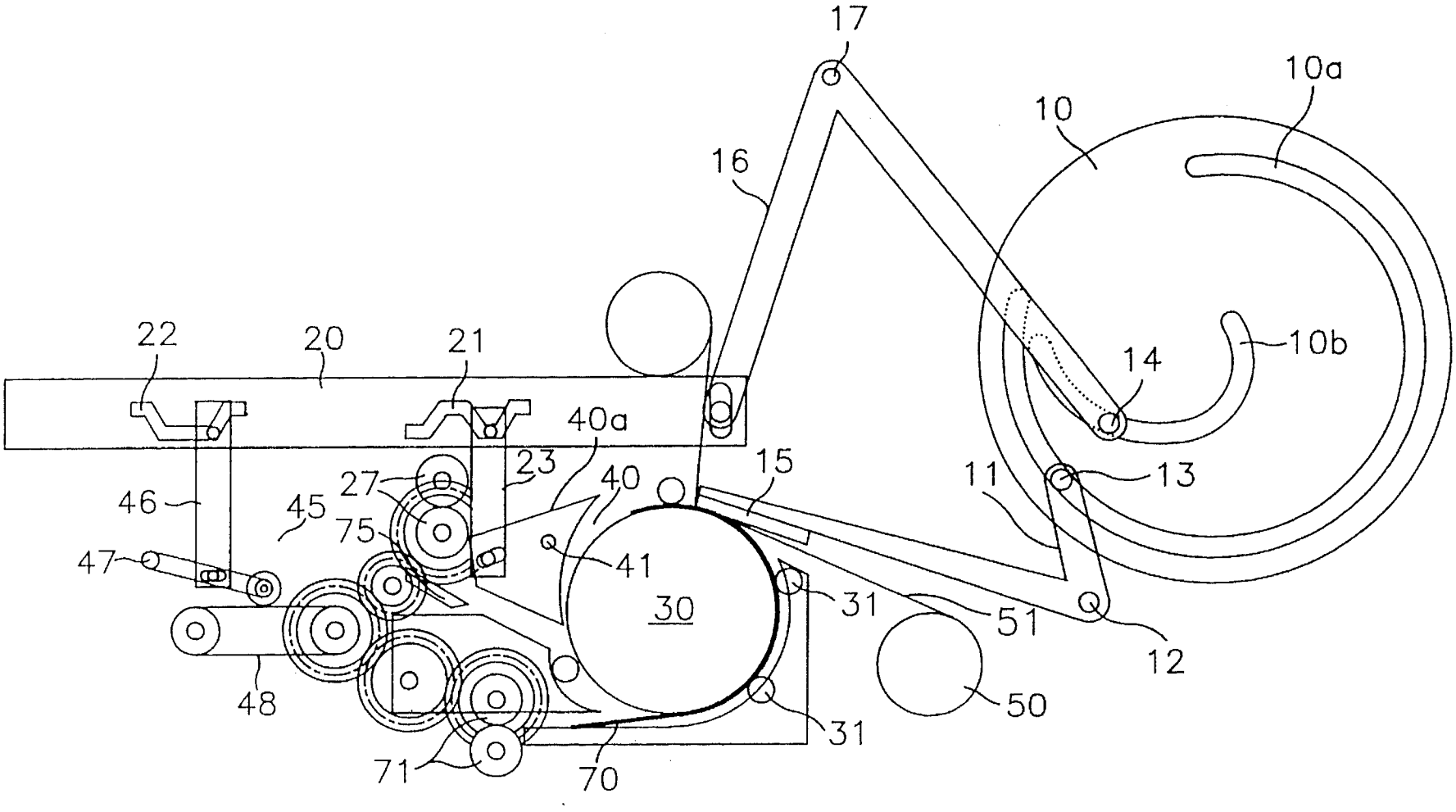

Thereafter, if the cam 10 moves, since the cam groove 10*a* is in a concentric circle with the cam 10 as shown in FIG. 4B, the thermal recording head 15 does not operate and the slider driving lever 16 is driven by the cam groove 10*b* while the thermal recording head 15 is in contact with the platen roller 30. Then the slider 20 is shifted to the left side and the bracket 23 moves downwards. Hence, the paper ejecting guide 40 rotates counterclockwise so as to pass the printing paper 70. Meanwhile, the re-feed paper roller 45 does not operate because the one end of the bracket 46 is still located on the flat bottom of the cam groove 22. In this case, the platen roller 30 rotates and a heating signal is generated from the thermal recording head 15, thereby printing yellow (Y) color (FIG. 4B).

Under such a state, if the platen roller 30 rotates once to complete the printing of yellow (Y) color, the cam 10 rotates reversely. Then the slider 20 is shifted to the initial position and simultaneously the thermal recording head 15 is lifted up. Further, the ribbon 51 moves to the position capable of printing magenta (M) color. Next, the cam 10 rotates, to maintain the state shown in FIG. 4B, and then magenta (M) color is printed. When the printing of magenta (M) is completed, the cam 10 rotates reversely, thereby lifting up the thermal recording head 15. Moreover, the ribbon 51 is shifted to the initial position capable of printing cyan (C) color.

As described above, the processes for printing magenta (M) color are the same as those for printing yellow (Y) color.

In order to print cyan (C) color, if the cam 10 operates and driven shafts 13 and 14 which are respectively inserted to the cam grooves 10*a* and 10*b* move to the ends of the cam grooves 10*a* and 10*b*, the thermal recording head driving lever 11 does not rotate along the drive shaft 13 moving on a concentric circle of the cam groove 10*a*, and the thermal recording head 15 maintains a closely contacted state with the platen roller 30. On the other hand, since the drive shaft 14 moving along the cam groove 10*b* becomes more distant from a center of the cam 10, the slider driving lever 16 revolves about the axis 17 and the slider 20 is shifted to the farthermost left side.

Figure 4C:
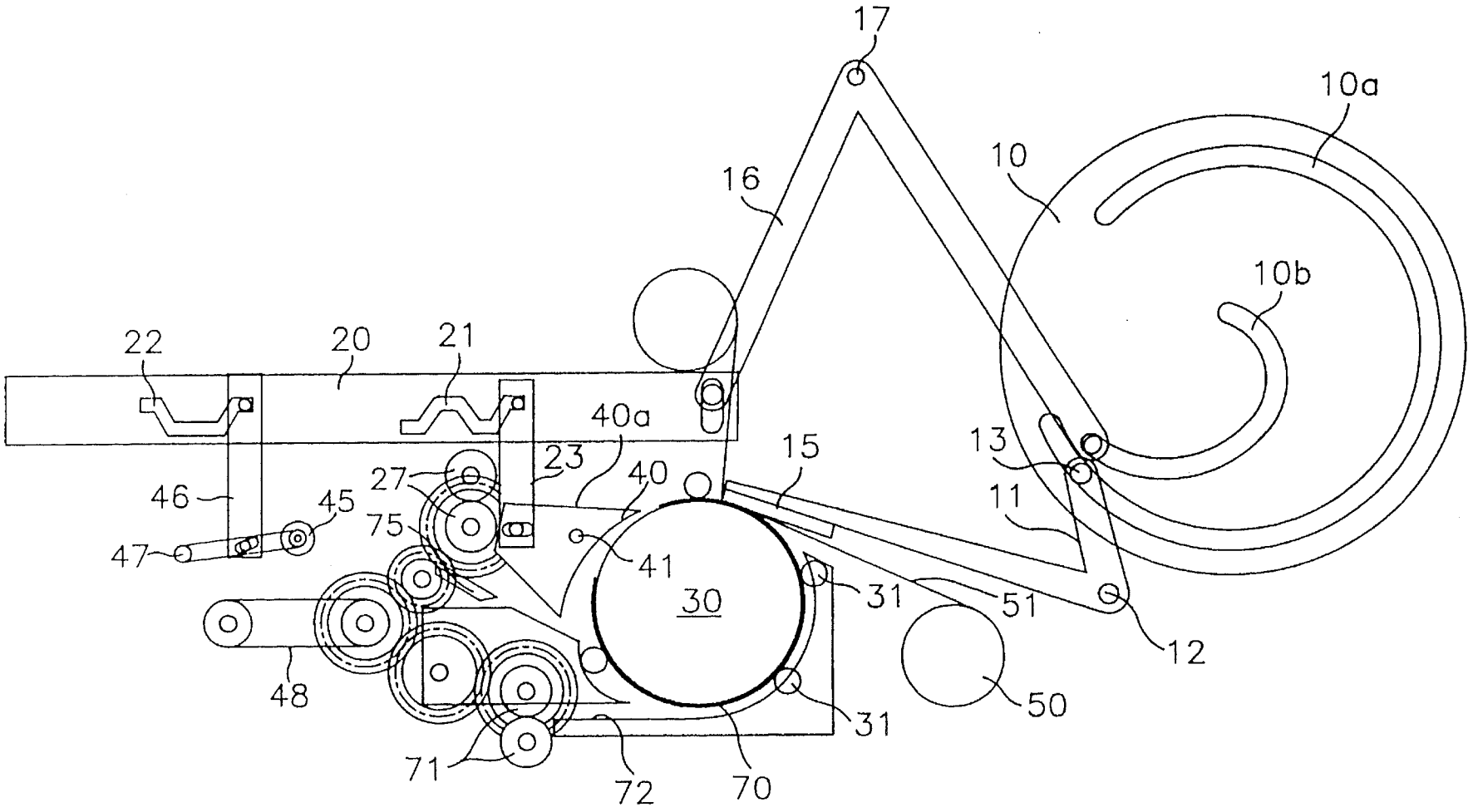
Figure 4D:
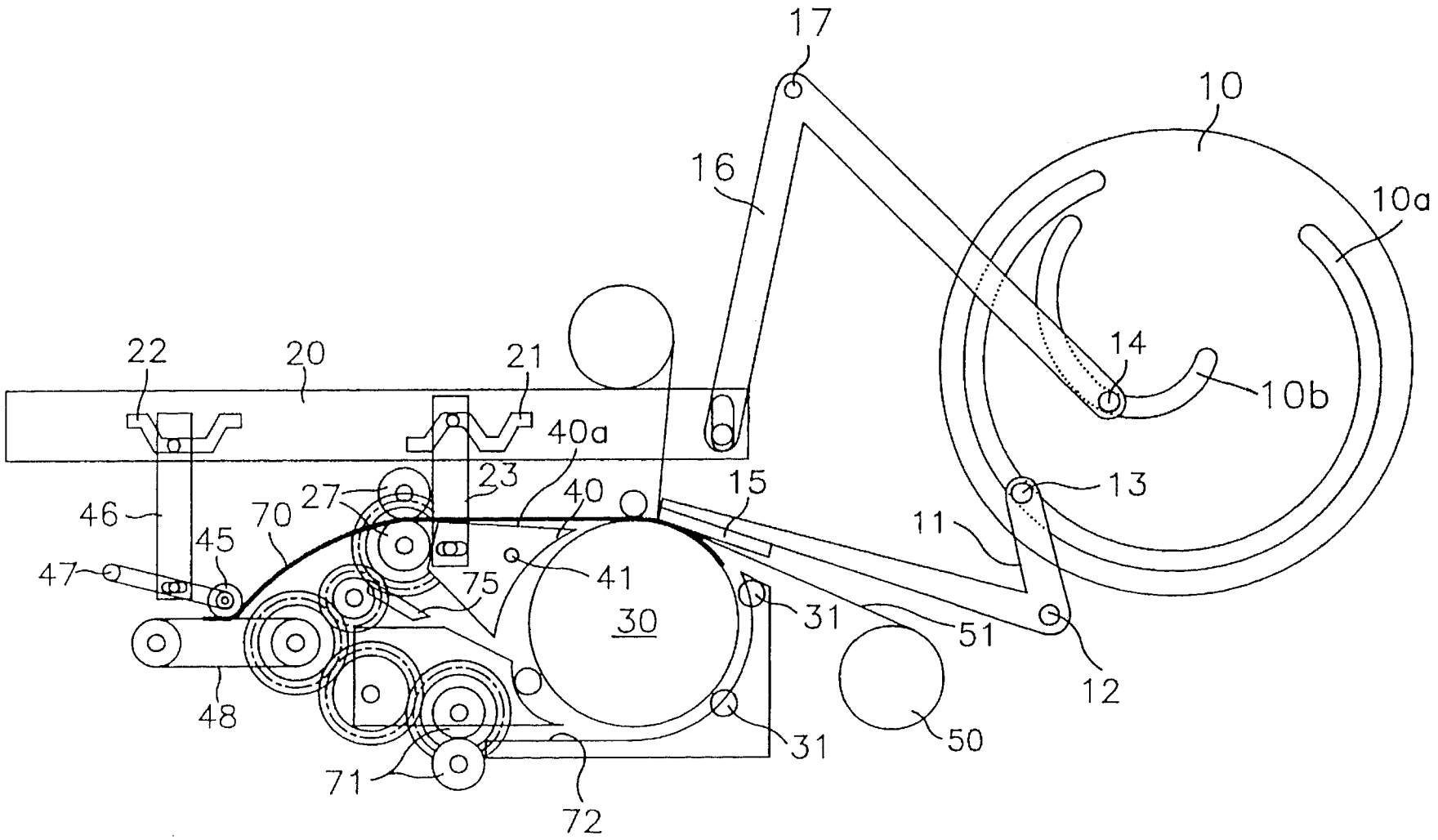

Consequently, the bracket 23 moves up and the paper ejecting guide 40 revolves clockwise about the hinge axis 41 and the end thereof is closely shifted to the platen roller 30. Further, since the bracket 46 is also shifted to the upper direction, the re-feed paper roller 45 rotates counterclockwise around the hinge axis 47 and is separated from a paper feed belt 48 (FIG. 4C).

At this time, if the platen roller 30 is driven, the printing of cyan (C) color is finished and simultaneously the top end of the printing paper 70 is guided to an upper surface 40*a* of the paper ejecting guide 40. Then the printing paper 70 is shifted through a paper ejecting roller 27. If the bottom end of the printing paper 70 is separated from the thermal recording head 15, then the cam 10 rotates reversely, to maintain the initial position. The thermal recording head 15 is then separated from the plate roller 30 and simultaneously the bracket 46 moves downwards. Thus, the re-feed paper roller 45 moves close to the paper feed belt 48 and the printing paper 70 is ejected.

Figure 4E:
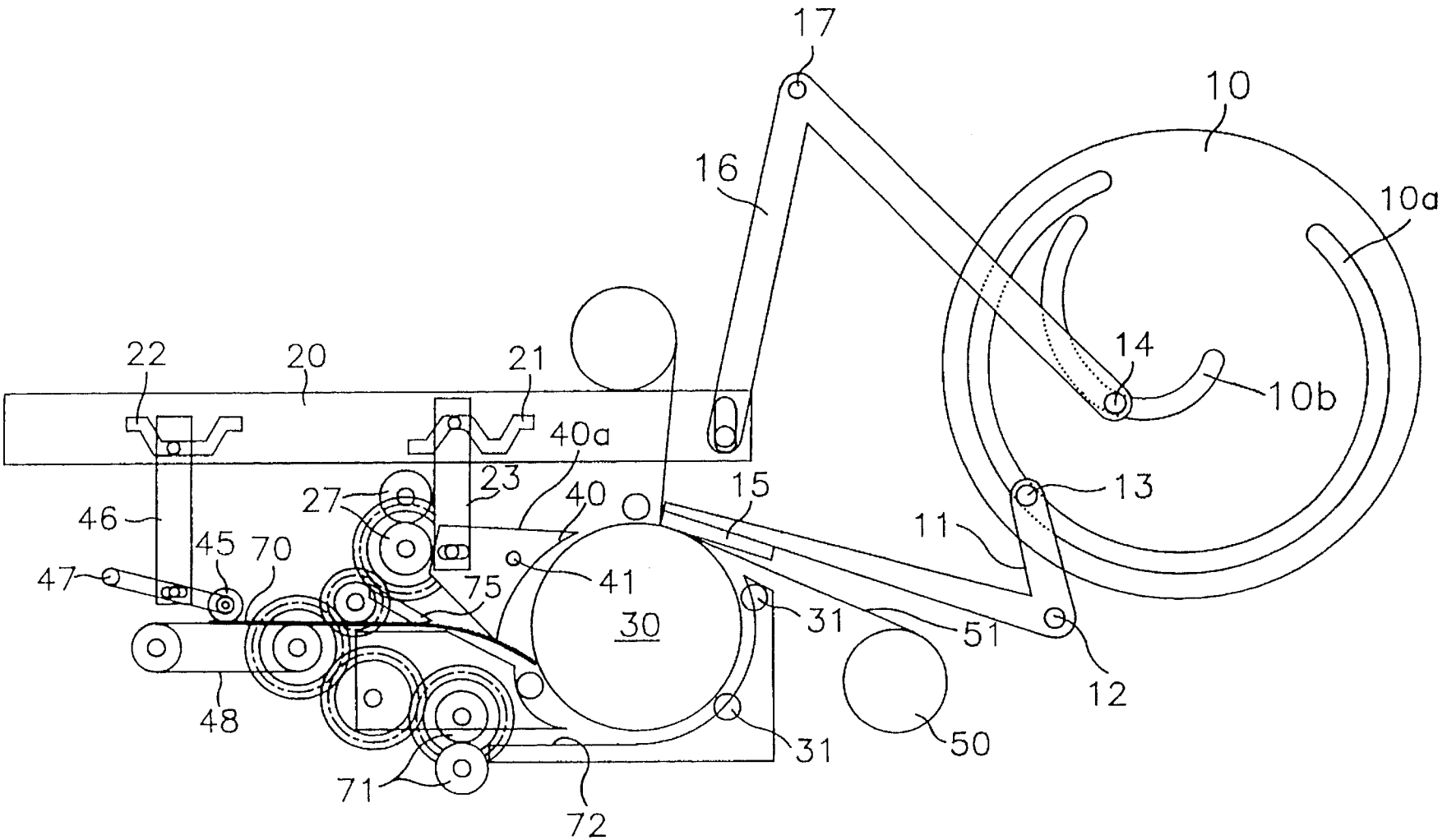

When printing on only one side of the printing paper 70, the paper feed belt 48 is counterclockwise driven to eject the printing paper 70. However, when printing on the double side of the printing paper 70, the re-feed paper roller 45 and the paper feed belt 48 rotate reversely before the bottom end of the printing paper 70 is separated from the refeed paper roller by sensing the bottom end of the printing paper 70, and then, the printing paper 70 is guided to a guide 75 so as to move to the platen roller 30. At this time, since the printed side of the printing paper 70 comes into contact with the platen roller 30, the other side of the printing paper 70 can be printed. (FIG. 4E).

Figure 1:
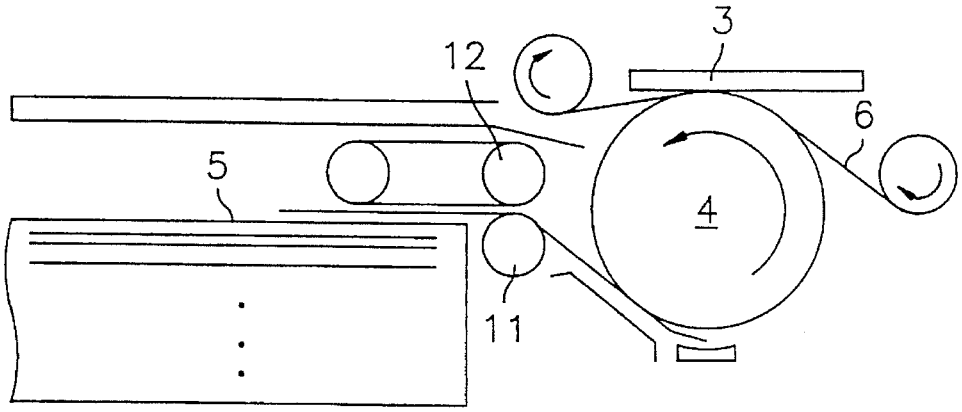
(PRIOR ART) FIG. 1
FIG. 1 is a schematic block diagram of a typical color video printer.
Figure 2:
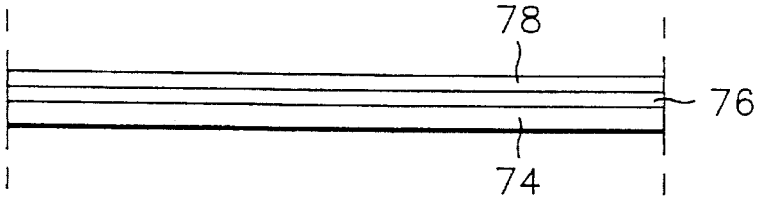
FIG. 2 is an enlarged sectional view of printing paper generally used for printing purposes.
Figure 5:
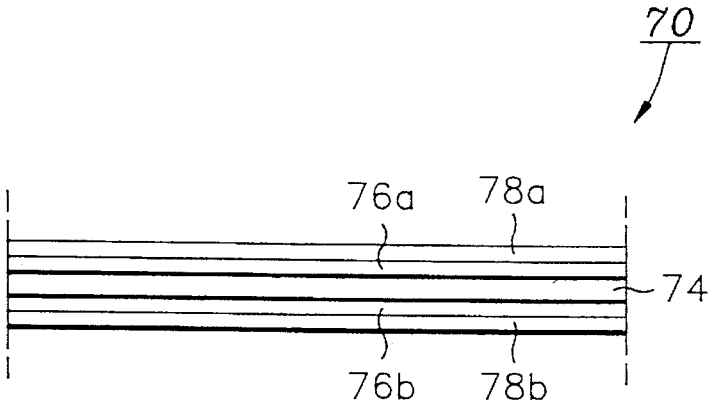
FIG. 5 is an enlarged sectional view of printing paper applied to the present invention.

As indicated in FIG. 5, in the printing paper 70, polyethylene layers 76*a* and 76*b* and dyestuffs absorptive layers 78*a* and 78*b* are symmetrically formed relative to the pulp layer 74. Therefore, it is possible to print on both sides of the printing paper 70.

As may be apparent from the aforementioned description, the illustrated embodiment of the present invention improves the printing speed by ejecting the printing paper while completing the printing of cyan (C) color and utilizes the printing paper efficiently by printing on both sides of the printing paper.

While preferred embodiments of the invention have been particularly shown and described, it will be understood by those skilled in the art that foregoing and other changes in form and details may be made without departing from the spirit and scope of the invention as defined in the appended claims.

What is claimed is:

1. A color video printer for printing onto both sides of a printing paper, comprising:

a platen roller;

a feed paper unit for feeding a printing paper to said platen roller for printing on one side of the printing paper;

a cam having a first cam groove and a second cam groove and being rotatably mounted;

a thermal recording head for selectively contacting said platen roller;

a first lever coupled to said thermal recording head and to said first cam groove of said cam;

a re-feed paper roller for re-feeding the printing paper toward said platen roller after the one side of the printing paper has been printed;

a guide for guiding the re-fed printing paper so said printing paper moves to said platen roller for printing on another side of the printing paper;

a second lever coupled to said second cam groove of said cam; and a slider coupled to said re-feed paper roller and to said second lever, wherein said thermal recording head and said slider are positioned by said cam throuqh said first lever and said second lever, respectively.

2. The color video printer as claimed in claim 1, wherein said slider includes slider cam groove, and a bracket for coupling said re-feed paper roller to said slider cam groove of said slider.

3. A color video printer for printing onto both sides of a paper, said color video printer comprising:

a platen roller;

a plurality of guide rollers positioned on a circumference of said platen roller;

a feed paper unit for feeding a printing paper to said platen roller for printing on one side of the printing paper;

a ribbon supplying unit for supplying an ink ribbon in proximity to said platen roller;

a thermal recording head for selectively contacting, together with said ink ribbon, said platen roller;

a cam having a first cam groove and a second cam groove and being rotatably mounted;

a first lever coupled to said thermal recording head and to said first cam groove of said cam;

a second lever coupled to said second cam groove of said cam;

a slider coupled to said second lever;

a paper ejecting guide, coupled to said slider, for ejecting the printing paper;

a re-feed paper roller, coupled to said slider, for re-feeding the printing paper toward said platen roller after the one side of the printing paper has been printed but prior to ejection; and a guide for guiding the re-fed printing paper so said printing paper moves to said platen roller for printing on another side of the printing paper, wherein said thermal recording head and said slider are positioned by said cam through said first lever and said second lever, respectively.

4. The color video printer as claimed in claim 3, wherein said slider includes a first slider cam groove, and a bracket for coupling said re-feed paper roller to said first slider cam groove.

5. The color video printer as claimed in claim 4, wherein said slider includes a second slider cam groove, and a bracket for coupling said paper ejecting guide to said second slider cam groove.

* * * * *